US005838224A

United States Patent [19]

Andrews

[11] Patent Number: 5,838,224

[45] Date of Patent: Nov. 17, 1998

[54] MEDICATION ORGANIZER ASSEMBLY

[76] Inventor: Joan L. Andrews, 2508 Wellston Rd., Avon Park, Fla. 33825

[21] Appl. No.: 873,680

[22] Filed: Jun. 12, 1997

[51] Int. Cl.[6] ..... G08B 1/00

[52] U.S. Cl. ..... 640/309.15; 340/309.4; 340/693; 340/815.45; 221/2; 368/10

[58] Field of Search ..... 340/309.15, 309.4, 340/691, 693, 573, 815.45, 568; 368/10; 221/2, 3, 15; 364/479, 569

[56] References Cited

U.S. PATENT DOCUMENTS

| | | | |
|---|---|---|---|
| 3,577,124 | 5/1971 | Kobayashi et al. | 340/309.15 |
| 4,731,765 | 3/1988 | Cole et al. | 368/10 |
| 5,221,024 | 6/1993 | Campbell | 221/3 |
| 5,291,191 | 3/1994 | Moore | 340/825.35 |
| 5,408,443 | 4/1995 | Weinberger | 368/10 |
| 5,646,912 | 7/1997 | Cousin | 368/10 |

*Primary Examiner*—Daniel J. Wu
*Attorney, Agent, or Firm*—Joseph N. Breaux

[57] ABSTRACT

A medication organizer assembly that includes a multiple sheet note/instruction pad secured to a base frame unit; the base frame unit including a house having a first plurality of medication drawers, a circuit compartment formed therein for receiving a time keeping, alarm and central processing circuit, a second plurality of medication drawer LED apertures, a liquid crystal display aperture, an hour time-set button aperture, a minute time-set button aperture, a master program button aperture, a repeat button aperture, and seven day/column sections, each day/column section including a third plurality of alarm segment aperture groupings and one day program aperture grouping, each of the third plurality of alarm segment aperture groupings having a red LED aperture, a green LED aperture, and an alarm acknowledge push-button aperture, the day program aperture grouping including a time push-button aperture, an enter push-button aperture and a clear push-button aperture; the multiple sheet note/instruction pad being secured to the base frame unit, each sheet of the multiple sheet note/instruction pad including multiple LED and alarm acknowledge push-button holes provided therethrough.

1 Claim, 4 Drawing Sheets

MEDICATION ORGANIZER ASSEMBLY

TECHNICAL FIELD

The present invention relates to organizers for medications and more particularly to a medication organizer assembly used to form a portion of a medication organizer, the medication organizer assembly including a multiple sheet note/instruction pad secured to a base frame unit; the base frame unit including a housing having a first plurality of medication drawers, a circuit compartment formed therein for receiving a time keeping, alarm and central processing circuit, a second plurality of medication drawer LED apertures, a liquid crystal display aperture, an hour time-set button aperture, a minute time-set button aperture, a master program button aperture, a repeat button aperture, and seven day/column sections, each day/column section including a third plurality of alarm segment aperture groupings and one day program aperture grouping, each of the third plurality of alarm segment aperture groupings having a red LED aperture, a green LED aperture, and an alarm acknowledge push-button aperture, the day program aperture grouping including a time push-button aperture, an enter push-button aperture and a clear push-button aperture; the multiple sheet note/instruction pad being secured to the base frame unit, each sheet of the multiple sheet note/instruction pad including multiple LED and alarm acknowledge push-button holes provided therethrough, the multiple LED and alarm acknowledge push-button holes being positioned on each the sheet in a manner such that the multiple LED and alarm acknowledge push-button holes are positionable in registration with the red LED aperture, the green LED aperture, and the alarm acknowledge push-button aperture of each of the third plurality of alarm segment aperture groupings, the first, second and third pluralities being equal in number. The medication organizer assembly is used to form a portion of a medication organizer that further includes a time keeping, alarm and central processing circuit housed within the circuit compartment of the housing; a number of medication drawer LED's corresponding to the first plurality that are responsive to the time keeping, alarm and central processing circuit; a liquid crystal display responsive to the time keeping, alarm and central processing circuit; an hour time-set button in connection with the time keeping, alarm and central processing circuit; a minute time-set button in connection with the time keeping, alarm and central processing circuit; a master program button in connection with the time keeping, alarm and central processing circuit; a repeat button in connection with the time keeping, alarm and central processing circuit; and a number of day/column component sections, each day/column component section including a third plurality of alarm segment component groupings and one day program component grouping, each alarm segment component grouping having a red LED responsive to the time keeping, alarm and central processing circuit, a green LED responsive to the time keeping, alarm and central processing circuit, and an alarm acknowledge push-button in connection with the time keeping, alarm and central processing circuit, the day program component grouping including a time push-button in connection with the time keeping, alarm and central processing circuit, an enter push-button in connection with the time keeping, alarm and central processing circuit, and a clear push-button in connection with the time keeping, alarm and central processing circuit.

BACKGROUND OF THE INVENTION

Many sick and/or infirm individuals require a large number of medications in order to maintain a degree of health.

Administering the dosage level and dosage scheduling of large numbers of medications can be difficult at best and at worst can lead to tragedy and death. It would be a benefit, therefore to individuals charged with the responsibility of organizing and dispensing these medications to an individual to have a medication organizer for assisting the individual to organize and dispense the medications in a safe and reliable manner. Because medications must often be given at different time of the day, it would of course be an advantage to have a medication organizer that allowed an individual to organize as many as eight medication taking events in a single day. Because the individual in charge of administering the medication may not be around when each medication taking event is needed, it would be an additional benefit to have a medication organizer that allowed an individual to organize as many as eight medication taking events a day for each day within a seven day period.

SUMMARY OF THE INVENTION

It is thus an object of the invention to provide a medication organizer assembly that includes a charting mechanism for assisting an individual to organize and dispense medications in a safe and reliable manner.

It is a further object of the invention to provide a medication organizer assembly that includes an organizing mechanism for allowing an individual to organize as many as eight medication taking events in a single day.

It is a still further object of the invention to provide a medication organizer assembly that includes an organizing mechanism for organizing as many as eight medication taking events a day for each day within a seven day period.

It is a still further object of the invention to provide a medication organizer assembly that includes a multiple sheet note/instruction pad secured to a base frame unit; the base frame unit including a housing having a first plurality of medication drawers, a circuit compartment formed therein for receiving a time keeping, alarm and central processing circuit, a second plurality of medication drawer LED apertures, a liquid crystal display aperture, an hour time-set button aperture, a minute time-set button aperture, a master program button aperture, a repeat button aperture, and seven day/column sections, each day/column section including a third plurality of alarm segment aperture groupings and one day program aperture grouping, each of the third plurality of alarm segment aperture groupings having a red LED aperture, a green LED aperture, and an alarm acknowledge push-button aperture, the day program aperture grouping including a time push-button aperture, an entire push-button aperture and a clear push-button aperture; the multiple sheet note/instruction pad being secured to the base frame unit, each sheet of the multiple sheet note/instruction pad including multiple LED and alarm acknowledge push-button holes provided therethrough, the multiple LED and alarm acknowledge push-button holes being positioned on each the sheet in a manner such that the multiple LED and alarm acknowledge push-button holes are positionable in registration with the red LED aperture, the green LED aperture, and the alarm acknowledge push-button aperture of each of the third plurality of alarm segment aperture groupings, the first, second and third pluralities being equal in number.

It is still further object of the invention to provide a medication organizer assembly that accomplishes some or all of the above objects in combination.

Accordingly, a medication organizer assembly is provided. The medication organizer assembly includes a multiple sheet note/instruction pad secured to a base frame unit;

the base frame unit including a housing having a first plurality of medication drawers, a circuit compartment formed therein for receiving a time keeping, alarm and central processing circuit, a second plurality of medication drawer LED apertures, a liquid crystal display aperture, an hour time-set button aperture, a minute time-set button aperture, a master program button aperture, a repeat button aperture, and seven day/column sections, each day/column section including a third plurality of alarm segment aperture groupings and one day program aperture grouping, each of the third plurality of alarm segment aperture groupings having a red LED aperture, a green LED aperture, and an alarm acknowledge push-button aperture, the day program aperture grouping including a time push-button aperture, an enter push-button aperture and a clear push-button aperture; the multiple sheet note/instruction pad being secured to the base frame unit, each sheet of the multiple sheet note/instruction pad including multiple LED and alarm acknowledge push-button holes provided therethrough, the multiple LED and alarm acknowledge push-button holes being positioned on each the sheet in a manner such that the multiple LED and alarm acknowledge push-button holes are positionable in registration with the red LED aperture, the green LED aperture, and the alarm acknowledge push-button aperture of each of the third plurality of alarm segment aperture groupings, the first, second and third pluralities being equal in number.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
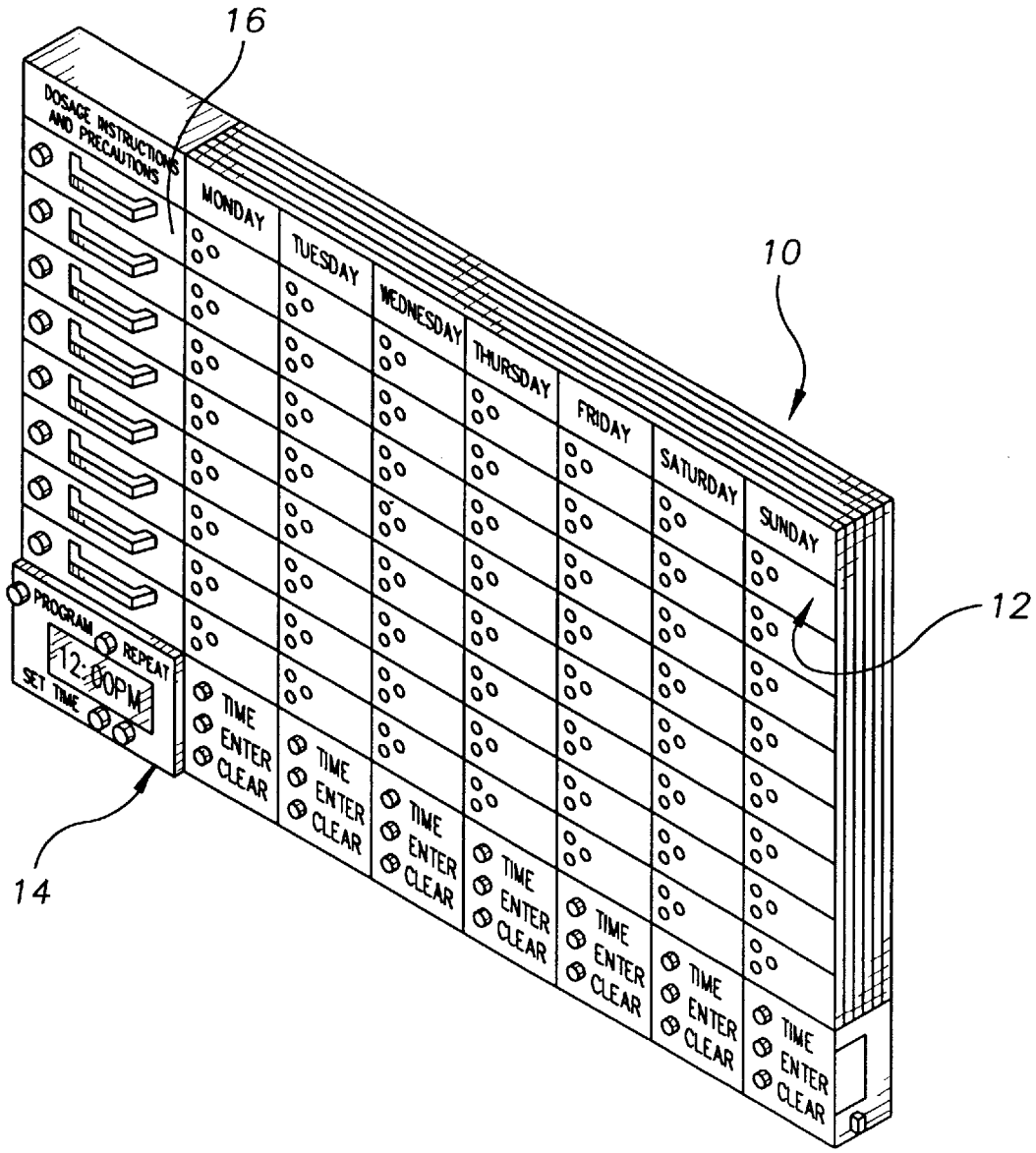
FIG. 1 is a perspective view of the medication organizer assembly of the present invention showing the multiple sheet note/instruction pad; and the base frame unit including the housing including the eight medication drawers; the eight corresponding medication drawer LED apertures, the liquid crystal display aperture; the hour time-set button aperture; the minute time-set button aperture; the master program button aperture; the repeat button aperture; and the eight day/column sections, each day/column section including eight alarm segment aperture groupings and one day program aperture grouping, each alarm segment grouping having a red LED aperture, a green LED aperture, and an alarm acknowledge push-button aperture, and the day program aperture grouping including a time push-button aperture, an enter push-button aperture, and a clear push-button aperture.

FIG. 1 shows a first exemplary embodiment of the medication organizer assembly of the present invention, generally designated by the numeral 10, forming a portion of a complete medication organizer. Medication organizer assembly 10 includes a multiple sheet note/instruction pad, generally designated 12; and a base frame unit, generally designated 14.

Figure 2:
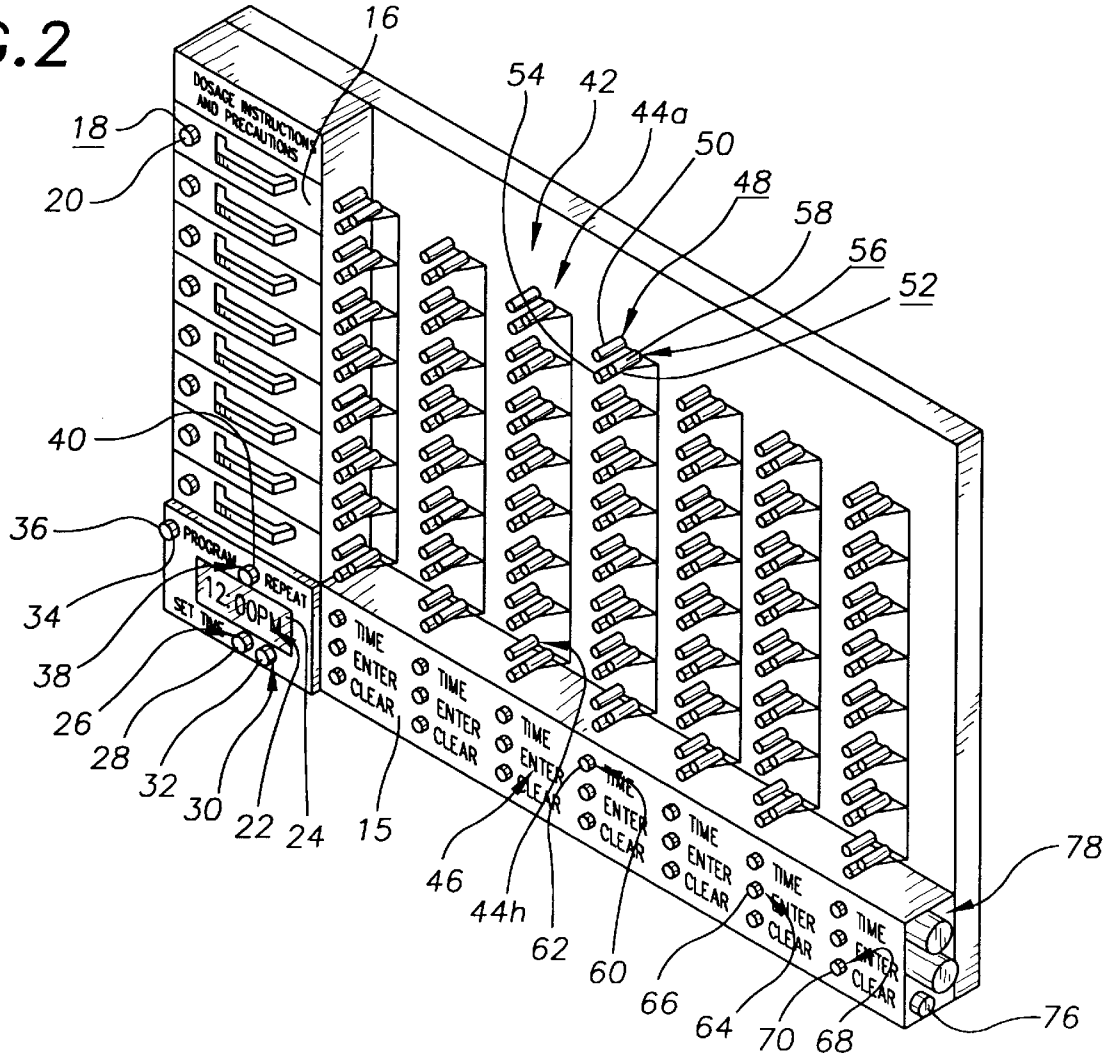
FIG. 2 is a perspective view of the medication organizer assembly of FIG. 1 with the battery compartment door of the base frame unit removed to show two representative batteries inserted into the battery compartment and the multiple sheet note/instruction pad removed to the show the elongated red LEDs extending out through the red LED apertures, the elongated green LEDs extending out of the green LED apertures, and the elongated alarm acknowledge push-buttons extending out of the alarm acknowledge push-button apertures of the eight alarm segment aperture groupings.

With reference to FIG. 2, base frame unit 14 includes a housing 15 that is molded from plastic and includes eight medication drawers 16; eight corresponding medication drawer LED apertures 18 each having a medication drawer LED 20 installed therein; a liquid crystal display aperture 22 having a liquid crystal display 24 installed therein; an hour time-set button aperture 26 having a hour time-set button momentary contact switch 28 installed therein; a minute time-set button aperture 30 having a minute time-set button momentary contact switch 32 installed therein; a master program button aperture 34 having a master program button momentary contact switch 36 installed therein; a repeat button aperture 38 having a repeat button momentary contact switch 40 installed therein; and eight day/column sections, generally designated 42, each day/column section 42 including eight alarm segment aperture groupings, generally designated 44*a–h* and one day program aperture grouping 46, each alarm segment aperture grouping having a red LED aperture 48 having an elongated red LED 50 installed therein, a green LED aperture 52 having an elongated green LED 54 installed therein, and an alarm acknowledge push-button aperture 56 having an elongated acknowledge push-button momentary contact switch 58 installed therein; each day program aperture grouping 46 including a time push-button aperture 60 having a time push-button momentary contact switch 62 installed therein, an enter push-button aperture 64 having an enter push-button momentary contact switch 66 installed therein, and a clear push-button aperture 68 having a clear push-button momentary contact switch 70 installed therein. Housing 15 also includes a battery compartment 74 and a conventional AC to DC converter jack 76.

Figure 3:
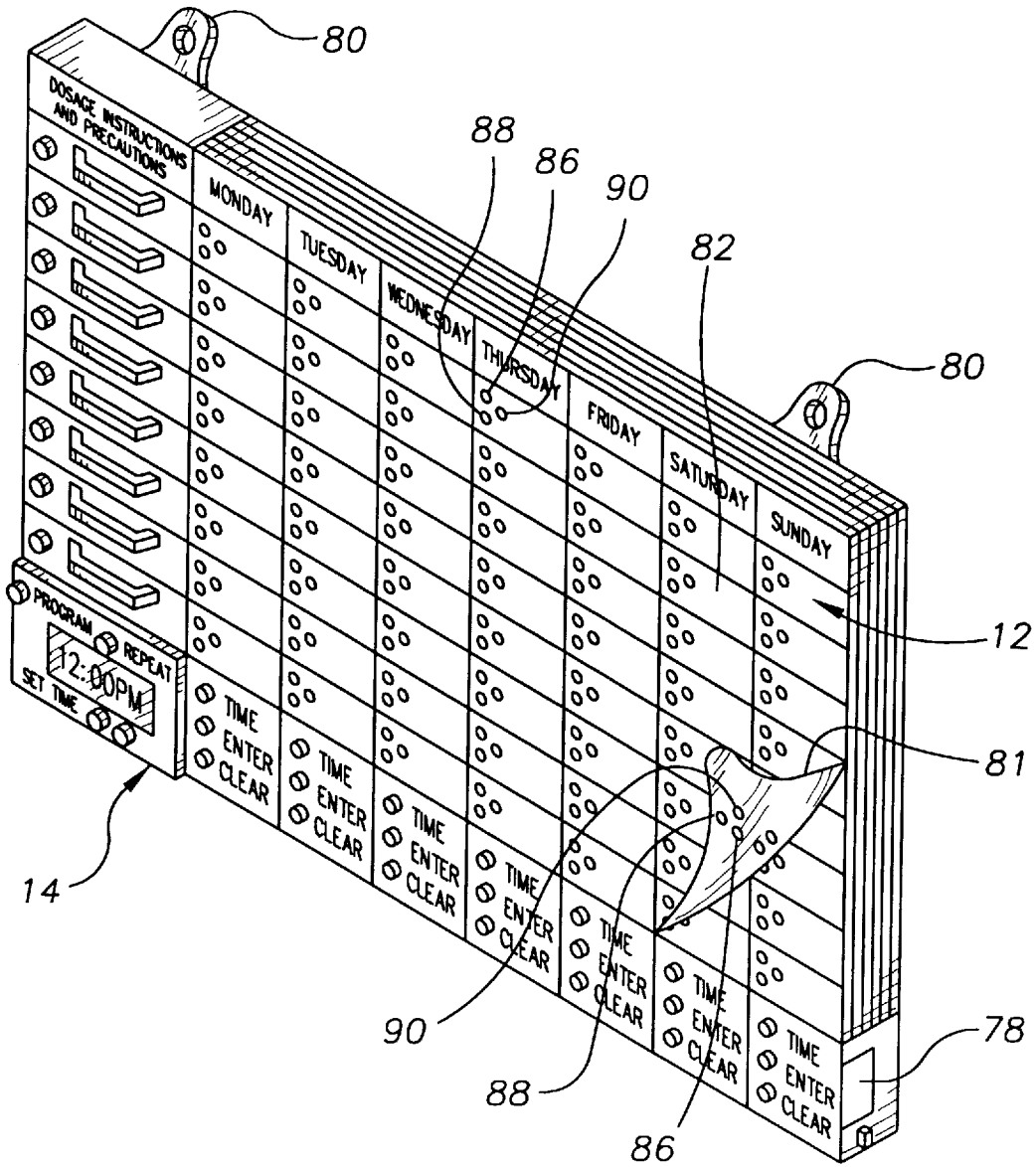
FIG. 3 is perspective view of the medication organizer assembly of FIG. 1 with one of the sheets of the multiple sheet note/instruction pad partially peeled back to show the multiple LED and alarm acknowledge push-button holes provided therethrough; and two exemplary, optional hanging mechanisms extending upwardly from the rear back edge of the base frame unit.

With reference to FIG. 3, battery compartment 74 (FIG. 2) is sealable with a compartment cover 78. In this embodiment, base unit 14 includes a pair of hanging tabs 80. Although hanging tabs 80 are used in this embodiment, other mechanisms for attaching base frame unit 14 to a surface, such as double faced tape and hanger notches, can also be used.

In this embodiment, multiple sheet note/instruction pad 12 is a conventional multiple sheet paper pad having markings printed on the surface of each individual sheet 81 designating fifty-six medication taking events that are organized into seven columns wherein each column contains eight rectangular shaped bounded message writing area 82. Each bounded message writing area 82 includes a red LED hole 86 in the upper left hand corner, a green LED hole 88 in the lower left hand corner and an alarm acknowledge push-button hole 90 positioned between green LED hole 88 and alarm acknowledge push-button hole 90. All of the red LED holes 86, the green LED holes 88 and the alarm acknowledge push-button holes 90 are positioned on each sheet 81 in a manner to be positionable in registration with the red LED apertures 48 (FIG. 2), the green LED apertures 52 (FIG. 2) and the alarm acknowledge push-button apertures 56 (FIG. 2) and positionable over the elongated red LEDs 50 (FIG. 2), the elongated green LEDs 54 (FIG. 2), and the elongated acknowledge push-button momentary contact switches 58 (FIG. 2).

Figure 4:
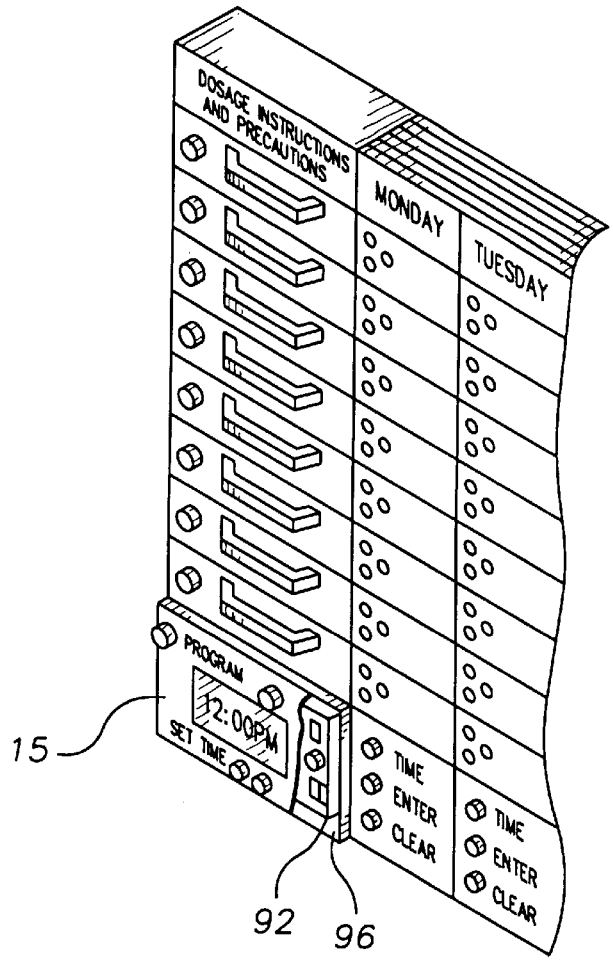
FIG. 4 is a detail perspective view showing the liquid crystal display installed within the liquid crystal display aperture and the time keeping, alarm and central processing circuit installed within the circuit compartment.

With reference to FIG. 4, the complete medication organizer also includes a time keeping, alarm and central processing circuit board 92. Time keeping, alarm and central processing circuit board 92 is mounted within a circuit board compartment 96 formed within housing 15.

Figure 5:
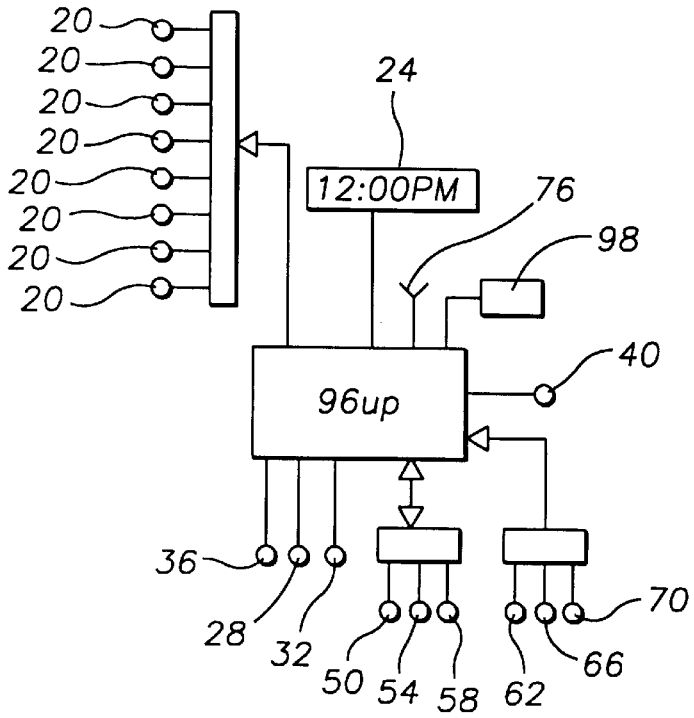
FIG. 5 is a schematic diagram showing the time keeping, alarm and central processing circuit, the eight optional, magnetically actuated, medication drawer locks; the eight corresponding medication drawer LED's, the liquid crystal display; the hour time-set button; the minute time-set button; the master program button; the repeat button; a representative alarm segment groupings including a red LED, a green LED, and an alarm acknowledge push-button; a representative day program grouping including a time push-button, an enter push-button, and a clear push-button; an AC to DC converter jack; and a battery connector.

With reference to FIG. 5, time keeping, alarm and central processing circuit board 92 includes a conventional microprocessor based computer circuit 96 that is interfaced with the eight medication drawer LEDs 20, the liquid crystal display 24, the hour time-set button momentary contact switch 28, the minute time-set button momentary contact switch 32, the master program button momentary contact switch 36, the repeat button momentary contact switch 40, the fifty-six elongated red LEDs 50, the fifty-six elongated green LEDs 54, the fifty-six elongated acknowledge push-button momentary contact switches 58, the seven time push-button momentary contact switches 62, the seven enter push-button momentary contact switches 66, the seven clear push-button momentary contact switches 70, and the AC to DC converter jack 76 and a battery connector 98.

Microprocessor based computer circuit 96 is programmed in a manner such that, in use, a user can program a series of individuals alarms. The individual alarms are programed by depressing the master program button momentary contact switch 36, depressing the time-push button momentary contact switch 62 under the desired day/column section 42, setting the time for the individual alarm by using the hour time-set button momentary contact switch 28 and the minute time-set button momentary contact switch 32, then storing the desired individual alarm time by depressing the enter push-button momentary contact switch 66 under the desired day/column section 42. When the individual alarm time is reached by the master clock, microprocessor based computer circuit 96 illuminates the red LED 50 within day/column section 42 and the medication drawer LED 20 that corresponds to number of the individual alarm for that day. For example, if five individual alarms are programmed for the Tuesday day/column section 42, and this alarm is the fourth alarm that has occurred for this day, the microprocessor based computer circuit 96 will illuminate the fourth red LED 50 from the top in the Tuesday day/column section 42 and the medication drawer LED 20 on the fourth medication drawer 16 from the top. The red LED 50 and the medication drawer LED 20 will stay illuminated until a user depresses the acknowledge push-button momentary contact switch 58 corresponding to the fourth red LED 50. The user will then open the fourth medication drawer 16 and remove and consume the medications contained therein.

It can be seen from the preceding description that a medication organizer assembly has been provided that includes a charting mechanism for assisting an individual to organize and dispense medications in a safe and reliable manner; that includes an organizing mechanism for allowing an individual to organize as many as eight medication taking events in a single day; that includes an organizing mechanism for organizing as many as eight medication taking events a day for each day within a seven day period; and that includes a multiple sheet note/instruction pad secured to a base frame unit, the base frame unit including a housing having a first plurality of medication drawers, a circuit compartment formed therein for receiving a time keeping, alarm and central processing circuit, a second plurality of medication drawer LED apertures, a liquid crystal display aperture, an hour time-set button aperture, a minute time-set button aperture, a master program button aperture, a repeat button aperture, and seven day/column sections, each day/column section including a third plurality of alarm segment aperture groupings and one day program aperture grouping, each of the third plurality of alarm segment aperture groupings having a red LED aperture, a green LED aperture, and an alarm acknowledge push-button aperture, the day program aperture grouping including a time push-button aperture, an enter push-button aperture and a clear push-button aperture; the multiple sheet note/instruction pad being secured to the base frame unit, each sheet of the multiple sheet note/instruction pad including multiple LED and alarm acknowledge push-button holes provided therethrough, the multiple LED and alarm acknowledge push-button holes being positioned on each the sheet in a manner such that the multiple LED and alarm acknowledge push-button holes are positionable in registration with the red LED aperture, the green LED aperture, and the alarm acknowledge push-button aperture of each of the third plurality of alarm segment aperture groupings, the first, second and third pluralities being equal in number.

It is noted that the embodiment of the medication organizer assembly described herein in detail for exemplary purposes is of course subject to many different variations in structure, design, application and methodology. Because many varying and different embodiments may be made within the scope of the inventive concept(s) herein taught, and because may modifications may be made in the embodiment herein detailed in accordance with the descriptive requirements of the law, it is to be understood that the details herein are to be interpreted as illustrative and not in a limiting sense.

What is claimed is:

1. A medication organizer assembly comprising:

a base frame unit including:

a housing having a first plurality of medication drawers, a circuit compartment formed therein for receiving a time keeping, alarm and central processing circuit, a second plurality of medication drawer LED apertures, a liquid crystal display aperture, an hour time-set button aperture, a minute time-set button aperture, a master program button aperture, a repeat button aperture, and seven day/column sections, each day/column section including a third plurality of alarm segment aperture groupings and one day program aperture grouping, each of said third plurality of alarm segment aperture groupings having a red LED aperture, a green LED aperture, and an alarm acknowledge push-button aperture, said day program aperture grouping including a time push-button aperture, an enter push-button aperture and a clear push-button aperture; and a multiple sheet note/instruction pad secured to said base frame unit, each sheet of said multiple sheet note/instruction pad including multiple LED and alarm acknowledge push-button holes provided therethrough, said multiple LED and alarm acknowledge push-button holes being positioned on each said sheet in a manner such that such multiple LED and alarm acknowledge push-button holes are positionable in registration with said red LED aperture, said green LED aperture, and said alarm acknowledge push-button aperture of each of said third plurality of alarm segment aperture groupings, said first, second and third pluralities being equal in number.

* * * * *